US007996939B2

(12) United States Patent
Benedict et al.

(10) Patent No.: US 7,996,939 B2
(45) Date of Patent: Aug. 16, 2011

(54) ELECTRO-HYDRAULICALLY POWERED LIFT AMBULANCE COT

(75) Inventors: William H. Benedict, Jamestown, OH (US); Robert C. Chinn, Cumming, GA (US); Warren Dale Sutton, St. Joseph, MO (US); Timothy P. Schroeder, Mason, OH (US); Brian Slick, Loveland, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 434 days.

(21) Appl. No.: 11/629,266

(22) PCT Filed: Jun. 3, 2005

(86) PCT No.: PCT/US2005/019547

§ 371 (c)(1),
(2), (4) Date: Jul. 29, 2008

(87) PCT Pub. No.: WO2005/122989

PCT Pub. Date: Dec. 29, 2005

(65) Prior Publication Data

US 2009/0172883 A1 Jul. 9, 2009

Related U.S. Application Data

(60) Provisional application No. 60/579,395, filed on Jun. 14, 2004.

(51) Int. Cl.

| | |
|---|---|
| ***A47B 7/00*** | (2006.01) |
| *A47B 1/00* | (2006.01) |
| *A47B 7/02* | (2006.01) |
| *A61G 7/10* | (2006.01) |

(52) U.S. Cl. ..... 5/611; 5/620; 5/626; 5/86.1; 5/614

(58) Field of Classification Search ..... 5/626, 625, 5/620, 611, 86.1, 614; 296/20, 19

See application file for complete search history.

(56) References Cited

U.S. PATENT DOCUMENTS 2,538,993 A 1/1951 Travis (Continued)

FOREIGN PATENT DOCUMENTS

DE 3541017 A1 6/1986

(Continued)

OTHER PUBLICATIONS

Australian Examination Report dated Jul. 6, 2010 pertaining to Australian Patent Application No. 2007210187.

(Continued)

*Primary Examiner* — Jonathan J Liu

(74) *Attorney, Agent, or Firm* — Dinsmore & Shohl LLP

(57) ABSTRACT

A collapsible hydraulically operated ambulance cot having a support frame, a wheeled base, a support mechanism disposed therebetween, and a lift system for hydraulically moving the upper frame relative to the lower frame is disclosed. The lift system permits a single attendant to raise the cot from a lowered position to a raised position, and an infinite number of positions therebetween, and to raise the wheeled base relative to the support frame to situate the cot onto an elevated surface such as the transport deck of an ambulance. A manual override is also provided to conserve battery power and as a back-up in no-power situations. It is to be appreciated that the above described manual override mode may be used when raising or lowering the cot without power assist, dropping the undercarriage when unloading from a vehicle, and lifting the undercarriage when loading into a vehicle.

17 Claims, 8 Drawing Sheets

U.S. PATENT DOCUMENTS

| | | | |
|---|---|---|---|
| 2,833,587 | A | 5/1958 | Saunders |
| 3,099,020 | A | 7/1963 | Garfield et al. |
| 3,174,722 | A | 3/1965 | Alm |
| 3,203,670 | A | 8/1965 | Farris |
| 3,815,164 | A | 6/1974 | Smith |
| 4,037,871 | A | 7/1977 | Bourgraf et al. |
| 4,071,222 | A | 1/1978 | Wright |
| 4,078,269 | A | 3/1978 | Weipert |
| 4,097,941 | A | 7/1978 | Merkel |
| 4,271,545 | A | 6/1981 | Christian, III |
| 4,352,991 | A | 10/1982 | Kaufman |
| 4,556,198 | A | 12/1985 | Tominaga |
| 4,558,847 | A | 12/1985 | Coates |
| 4,613,122 | A | 9/1986 | Manabe |
| 4,646,211 | A | 2/1987 | Gallant et al. |
| 4,675,926 | A | 6/1987 | Lindblom et al. |
| 4,912,787 | A | 4/1990 | Bradcovich |
| 4,984,774 | A | 1/1991 | Zupancic et al. |
| 5,022,105 | A | 6/1991 | Catoe |
| 5,054,141 | A | 10/1991 | Foster et al. |
| 5,074,000 | A | 12/1991 | Soltani et al. |
| 5,083,331 | A | 1/1992 | Schnelle et al. |
| 5,084,922 | A | 2/1992 | Louit |
| 5,135,350 | A | 8/1992 | Eelman et al. |
| 5,271,113 | A | 12/1993 | White |
| 5,365,622 | A | 11/1994 | Schirmer |
| 5,495,914 | A | 3/1996 | DiMucci et al. |
| 5,537,700 | A | 7/1996 | Way et al. |
| 5,575,026 | A | 11/1996 | Way et al. |
| 5,662,627 | A | 9/1997 | Say |
| 5,697,471 | A | 12/1997 | DiMucci et al. |
| 5,701,618 | A | 12/1997 | Brugger |
| 5,740,884 | A | 4/1998 | DiMucci et al. |
| 5,983,425 | A | 11/1999 | DiMucci et al. |
| 6,024,528 | A | 2/2000 | Taylor |
| 6,219,864 | B1 | 4/2001 | Ellis et al. |
| 6,332,638 | B1 | 12/2001 | Menna |
| 6,701,545 | B1 | 3/2004 | Ferneau et al. |
| 6,916,056 | B2 | 7/2005 | Mitchell et al. |
| 7,521,891 | B2 | 4/2009 | Choy et al. |
| 2002/0174486 | A1 | 11/2002 | Van Den Heuvel et al. |
| 2003/0037375 | A1 | 2/2003 | Riley et al. |
| 2003/0079288 | A1 | 5/2003 | Cook et al. |
| 2004/0055087 | A1 | 3/2004 | Edgerton |
| 2004/0080172 | A1 | 4/2004 | Mitchell et al. |
| 2004/0088792 | A1 | 5/2004 | O'Krangley et al. |
| 2005/0011188 | A1 * | 1/2005 | Silva et al. ..... 60/405 |
| 2005/0035871 | A1 | 2/2005 | Dixon et al. |
| 2006/0259267 | A1 | 11/2006 | Narayanasamy |

FOREIGN PATENT DOCUMENTS

| | | | |
|---|---|---|---|
| FR | 2786091 | A1 | 5/2000 |
| GB | 2302672 | A | 1/1997 |
| GB | 2351439 | A | 1/2001 |
| GB | 2368317 | A | 5/2002 |
| GB | 2390062 | A | 12/2003 |
| JP | 63125837 | | 9/1988 |
| JP | 2003159301 | A | 6/2003 |
| WO | WO 0239944 | A2 | 5/2002 |
| WO | WO2004064698 | * | 8/2004 |
| ZA | 200806565 | A | 6/2009 |

OTHER PUBLICATIONS

Chinese Office Action dated Apr. 28, 2010 pertaining to Chinese Application No. 200780008218.X.

Chinese Office Action dated May 8, 2009 pertaining to Chinese Application No. 200580024153.9.

Australian Examiner's first report dated Jan. 21, 2010 pertaining to Australian patent application No. 2005253943.

European Examination Report dated Feb. 6, 2009 pertaining to European Application No. 05 756 309.0.

International Search Report and Written Opinion dated Jun. 15, 2007 pertaining to International application No. PCT/US2007/001839.

Japanese Office Action pertaining to Japanese Application No. 2007-516528, dated Oct. 4, 2010.

* cited by examiner

ELECTRO-HYDRAULICALLY POWERED LIFT AMBULANCE COT

This invention relates to ambulance cots and more particularly to an ambulance cot having an electro-hydraulically, operated collapsible frame structure to facilitate loading of the ambulance cot from the ground and into an ambulance by a single operator.

In order to situate a conventional non-powered ambulance cot into the back of an ambulance, two or more attendants often must lift the cot from a relatively low height of approximately 15 cm (about 6 inches) from the ground to a height of almost 1 meter (about 39 inches). Unfortunately, lifting or raising a loaded ambulance cot from this low height increases the risk to these attendants obtaining a back injury or exacerbating an existing one. This problem is exacerbated when handling and transporting a bariatric patient.

It is against the above background, that the present invention provides a hydraulic lift system to an ambulance cot which will be used to assume all or most of the effort required to lift and/or lower the cot and patient carried thereon. The present invention by providing a power lift ambulance cot for emergency medical services and ambulance-related services addresses the problems associated with the physical strain of raising and lowering a loaded ambulance cot. Accordingly, the present invention has the potential to reduce work related injuries and to reduce the amount of lost work time, as well as therapeutic costs.

Although the present invention is not limited to following specific advantages, it is noted that the present invention allows an attendant to raise or lower a patient with only the touch of a button to activate the hydraulic lift system. When using the hydraulic lift system of the present invention, the cot will lift a patient up to about 363 kilograms (about 700 pounds), thereby addressing scenarios where attendants may be put into a situation where they can injure their back while handling a bariatric patient.

The present invention uses an x-frame design with two hydraulic lift cylinders for raising and lowering the patient, and for providing a smooth and balanced lift operation to the cot. Since the weight of the patient is taken off the attendants and put onto the hydraulic lift system, both attendants now have the ability to assist in holding the weight at the trailing (operator) end of the cot as it's being loaded into a vehicle. Being able to situate the two attendants at the trailing end of the cot allows for an easier loading of the cot into the vehicle, especially one's with floors higher than about 0.7 meters (about 30 inches). It is also to be appreciated that the present invention has an infinite height adjustment range to meet all of the attendant's needed loading positions in order to transfer a patient to and from the cot.

In one embodiment, an electro-hydraulically powered lift ambulance cot comprising a wheeled base having a first slide member slidably supported by a longitudinally extending lower guide is disclosed. A support frame has a second slide member slidably supported by a longitudinally extending upper guide, and is disposed above the wheeled base. A support mechanism, which supports the support frame relative to the wheeled base, is pivotably connected to the support frame, the wheeled base, the first slide member, and the second slide member. A hydraulic lift system is pivotably mounted at a first end to the first slide member, and at a second end to the support mechanism. A motor is mounted to the cot to pump hydraulic fluid under pressure to the lift system in order to assist relative movement between the support frame and the wheeled base. Pilot operated check valves "lock" hydraulic cylinders of the lift system in place when the pump is de-energized to maintain the cot in its desired position. A manual override is also provided to conserve battery power and as a back-up in no-power situations. It is to be appreciated that the above described manual override mode may be used when raising or lowering the cot without power assist, dropping the undercarriage when unloading from a vehicle, and lifting the undercarriage when loading into a vehicle.

These and other features and advantages of the invention will be more fully understood from the following description of a preferred embodiment of the invention taken together with the accompanying drawings. It is noted that the scope of the claims is defined by the recitations therein and not by the specific discussion of features and advantages set forth in the present description.

The following detailed description of the embodiments of the present invention can be best understood when read in conjunction with the following drawings, where like structure is indicated with like reference numerals and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention. Additionally, parts and portion of some elements may be removed to help improve understanding of the embodiments of the present invention.

With reference to FIGS. 1-5, a retractable ambulance cot according to one embodiment of this invention is shown generally as 2. Upon the cot 2 a patient 4 may be supported, and conveniently loaded onto an elevated surface 6, such as for example, the transport bay of an ambulance. It is to be appreciated that the cot 2 functions at ambulance load heights up to about 0.9 meters (about 34 inches), thereby reducing the physical strain of loading an ambulance cot into an ambulance. Additionally, it is to be appreciated that the cot 2 unloaded weighs less than about 61 kilograms (about 135 pounds). The overall dimensions of the cot 2 is about 2.1 meters (about 83 inches) long by about 0.6 meters (about 24 inches) wide by about 0.33 meters (about 13 inches) high in the fully lowered position, a position illustrated by FIG. 2.

Figure 1:
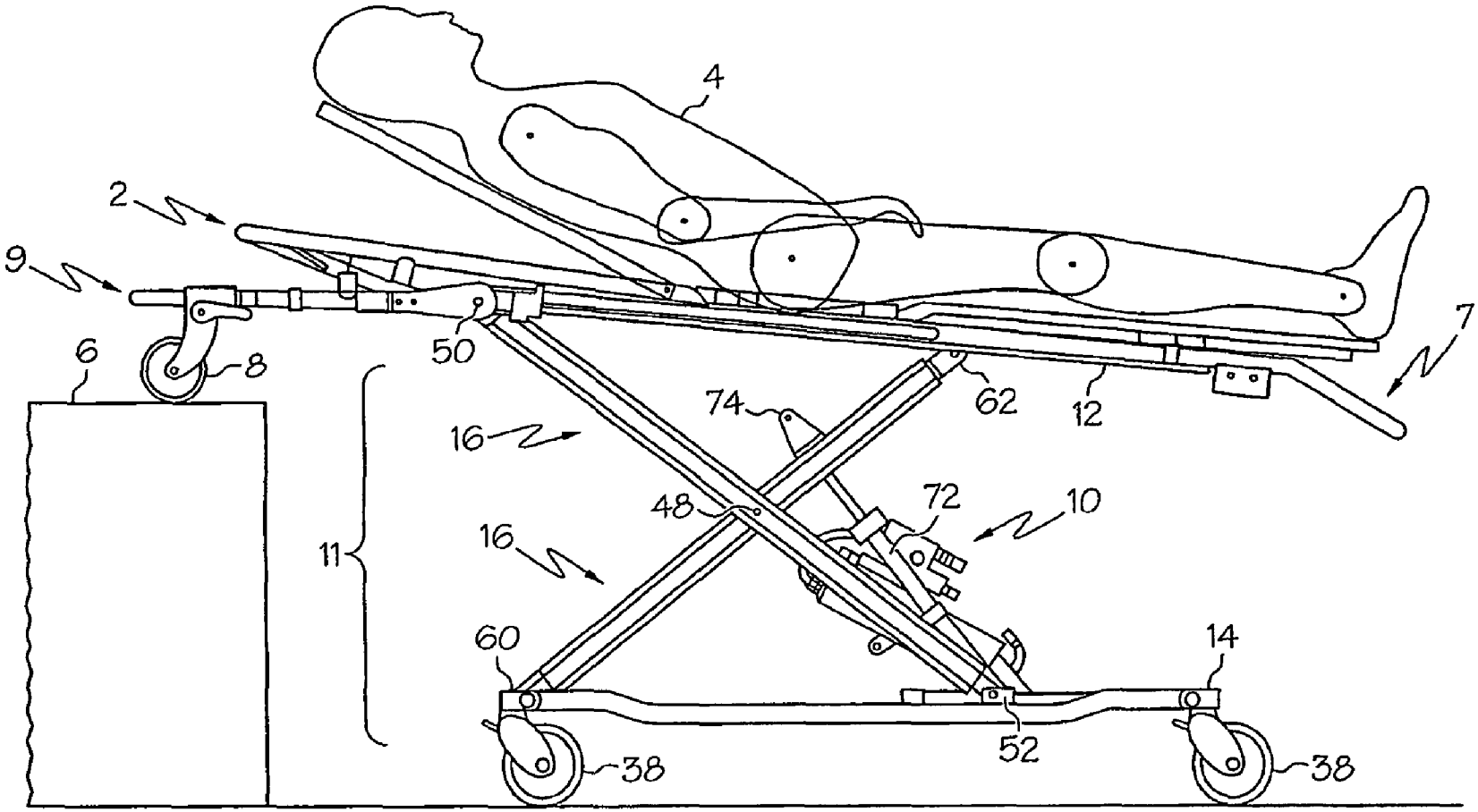
FIG. 1 is an illustrated side view of a cot according to the invention situated in a fully elevated position.
Figure 2:
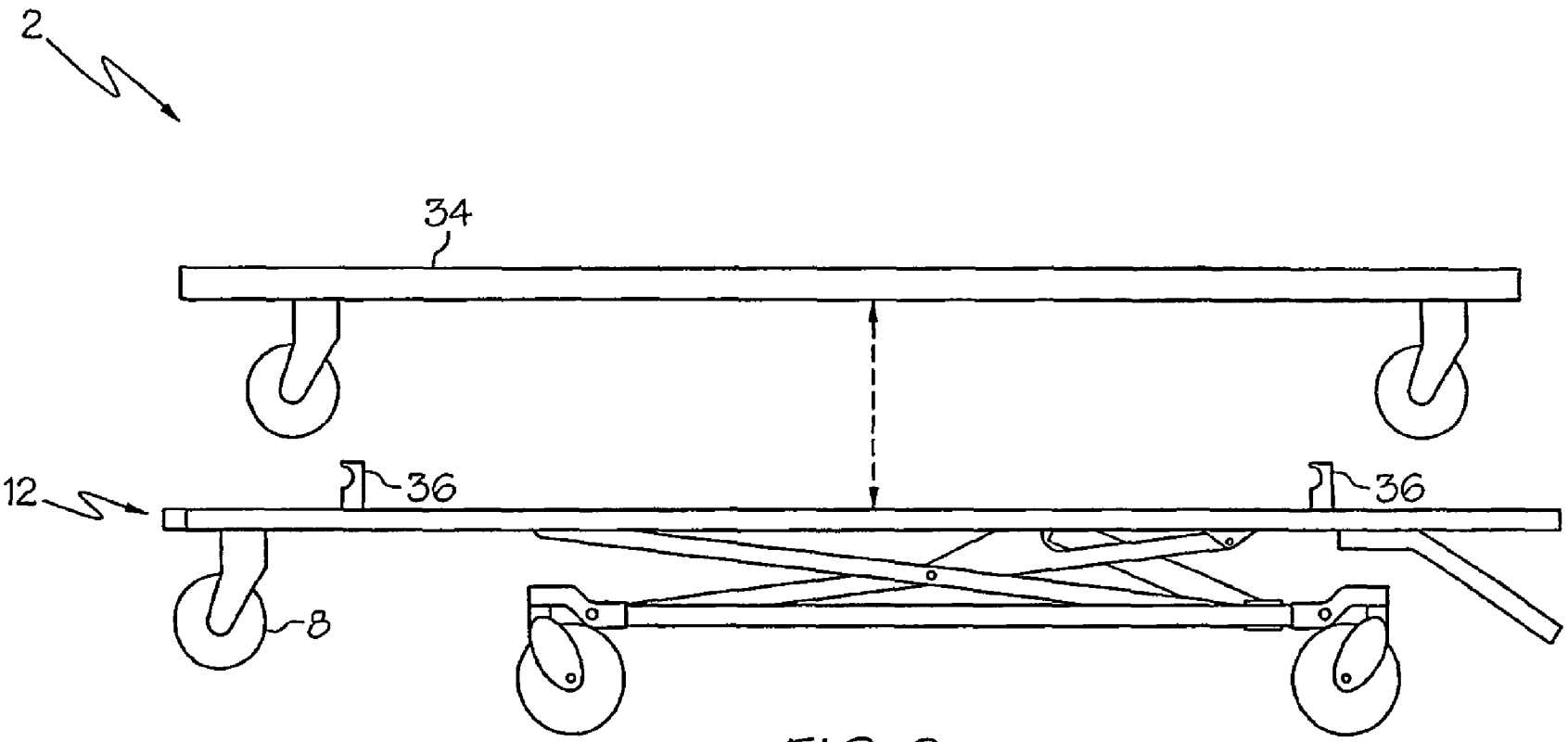
FIG. 2 is an illustrated side view of a cot according to the invention in a lowered position.

Referring to FIG. 1, the cot 2 is illustrated in a fully elevated position. It is to be appreciated that a single attendant can hold and manipulate the trailing end 7 of the cot 2 in the elevated position in order to rest loading wheels 8 provided at the leading end 9 of the cot onto the elevated surface 6. Operation of an associated hydraulic lift system, shown generally as 10, as described herein in a later section, causes the undercarriage to be hydraulically raised to the level of the elevated surface 6 allowing the attendant to transfer the cot 2 thereon in a lowered position, such as depicted by FIG. 2. It is to be appreciated that the cot 2 when situated in a fully lowered position, loading wheels 8 and swivel wheels 38 support the cot 2 upon the elevated surface 6.

The hydraulic lift system 10 also hydraulically raises the cot 2 from the lowered position to the raised position, and an infinite number of positions therebetween. Pressure in the hydraulic lift system 10 may also be manually released to cause the cot 2 to be lowered from the raised position to the lowered position, and an infinite number of positions therebetween, to conserve battery power and as a back-up in no-power situations. It is also to be appreciated that the above described manual mode may also be used when raising the cot without power assist, dropping the undercarriage when unloading from a vehicle, and lifting the undercarriage when loading into a vehicle.

The undercarriage, generally indicated by symbol 11, of the cot 2 comprises an upper frame 12, a lower frame 14, and a support mechanism shown generally as 16 disposed therebetween for supporting the upper frame 12 relative to the lower frame 14. The upper frame 12 is generally rectangular, and in the illustrated embodiment shown by FIG. 3, comprises at the leading end 9, a leading end frame member 18 coupled to a pair of opposed, longitudinally extending side frame members 20, 20'. At the trailing end 7, the side frame members 20, 20' are coupled rotatably to a trailing end frame member 22, having a bent U-shape. The frame members 18, 20, 20', and 22 are a tubular material, such as metal, laminate, plastics, or combinations thereof.

In the illustrated embodiment, the leading end frame member 18 is coupled rotatably to the opposed side frame members 20, 20' and is a drop frame, such as the type disclosed by U.S. Pat. No. 6,701,545, a patent commonly assigned to Ferno Washington, Inc., and the disclosure of which is herein fully incorporated by reference. The loading wheels 8 are provided to the leading end frame member 18.

Figure 3:
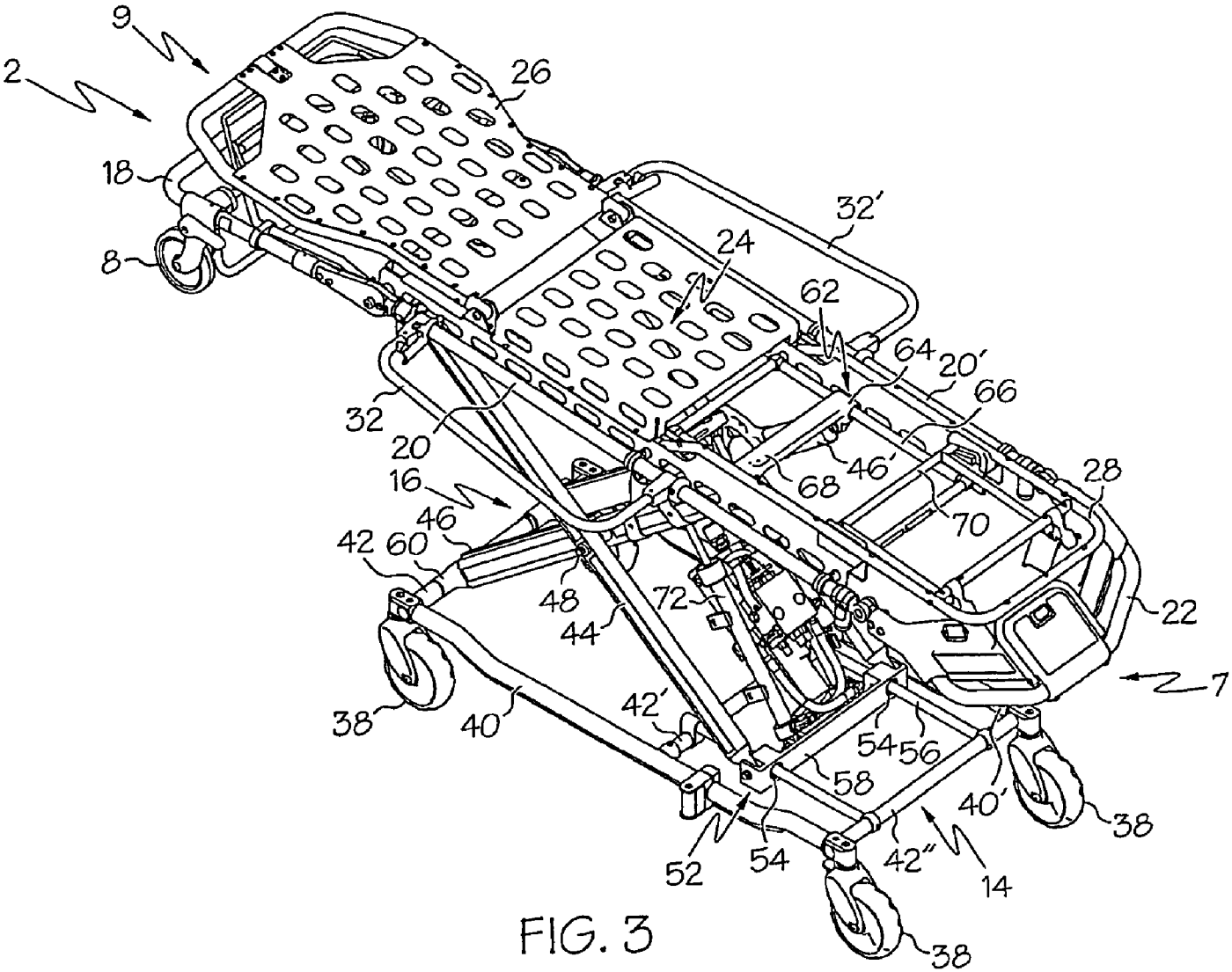
FIG. 3 is an illustrated elevated perspective view of a first side of a cot according to the invention, with parts removed for ease of illustration.
Figure 5:
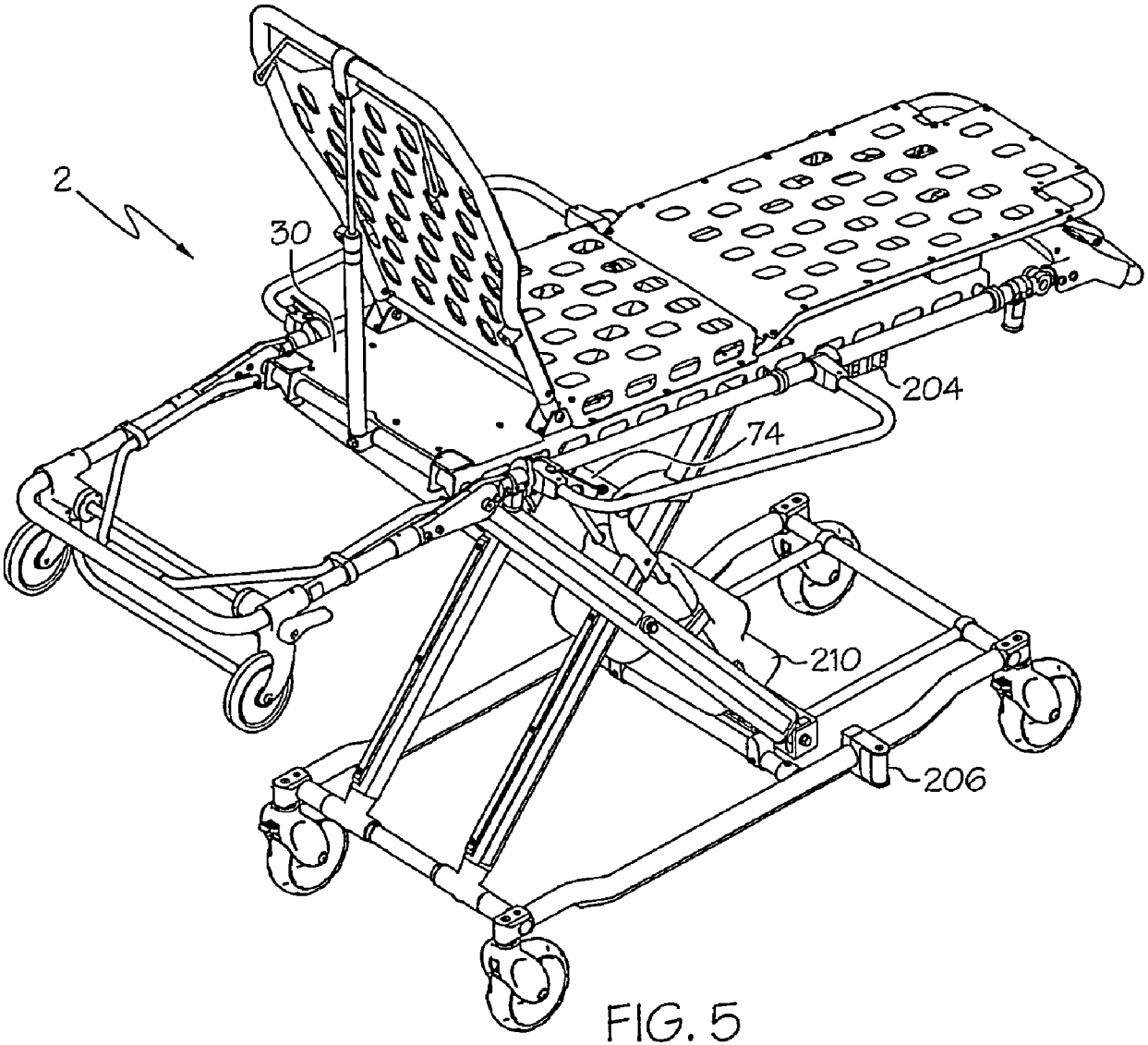
FIG. 5 is an illustrated elevated perspective view of a cot according to the invention.

In one embodiment, the upper frame 12 includes a patient bed shown generally as 24 in FIG. 3, upon which the patient 4 rests, as is illustrated in FIG. 1. The patient bed 24 includes raisable back and leg rests 26 and 28, respectively. Situated below the back rest 26 is a battery 30, which is best shown by FIG. 5. Battery 30 provides the necessary power to operate the hydraulic lift system 10 according to the invention, and is rechargeable without being removed from the cot via an electric connection to an external source. It is to be appreciated that the term "battery" includes single cell batteries and multiple cell batteries.

Figure 8:
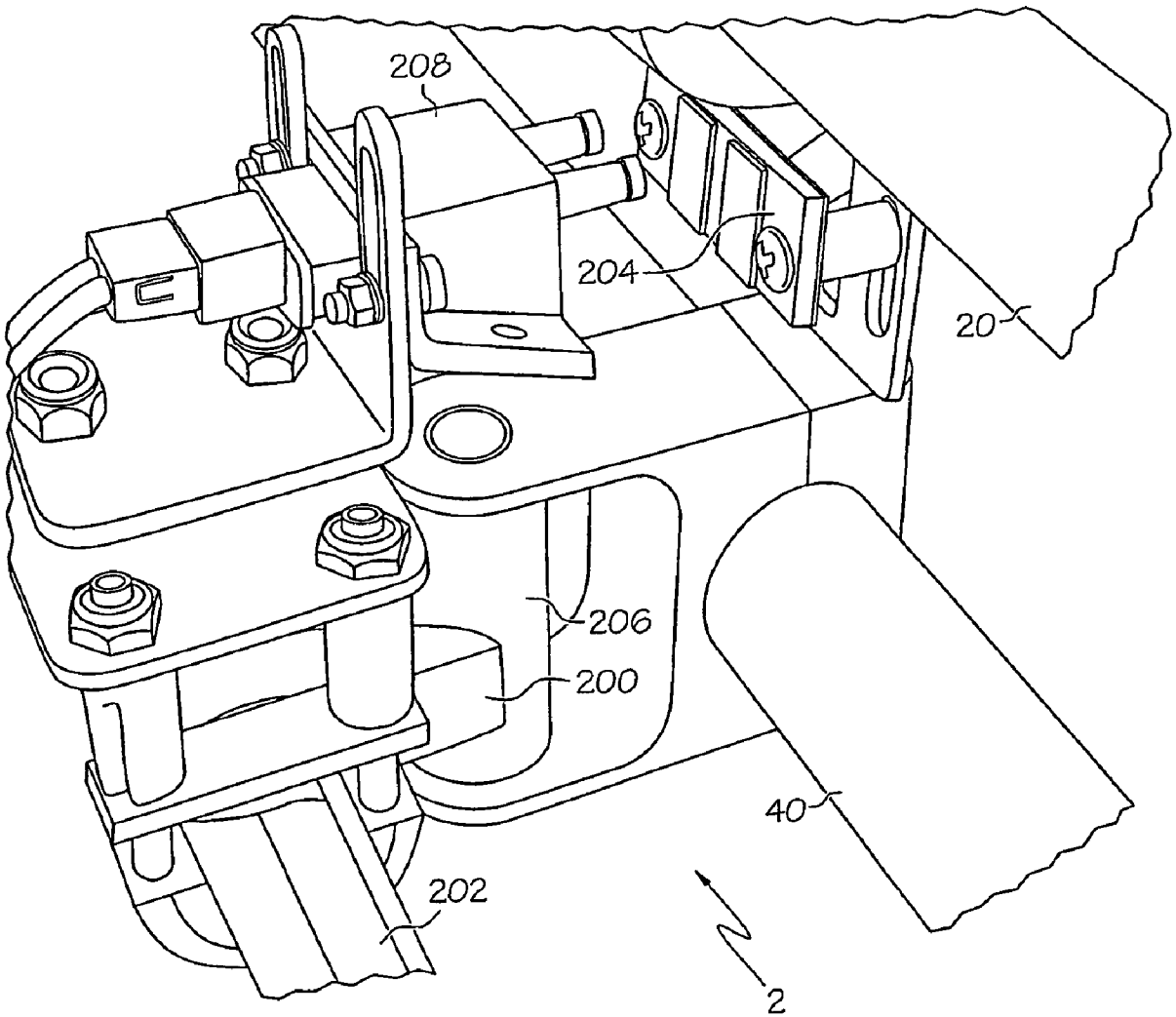
FIG. 8 is an illustrated close-up section view of a portion of a cot according to the invention showing a charging connection.

In one embodiment, an electrical connection is made through the use of an extension cord (not shown). In another embodiment, such as illustrated by FIG. 8, an electrical connection is made through a cot fastening device 200 situated in an emergency vehicle, represented by portion 202. The cot 2 in the illustrated embodiment provides an electrical contact pad 204 adjacent a fastening member 206 that is mounted to the cot. As shown by FIG. 5, in one embodiment, the electrical contact pads 204 and fastening member 206 are provided to the side frame members 20 and 40, respectively. In another embodiment the electrical contact pads 204 may be situated with the fastening member 206 on the lower frame 14 of the cot 2, or vice versa. In any of the embodiments, when the cot 2 is situated into the emergency vehicle and the fastening device 200 releasably securing the fastening member 206, an electric connection with an external source, such the vehicles electrical system, is made. An electrical connection is made through the use of electrical prongs 208 provided adjacent the fastening device 200, and which contact the electrical contact pads 204. It is to be appreciated that movable protective covers may be provided to one or both of the contact pads and electric prongs.

The battery 30, which in one embodiment provides 24 VDC, 25 amps, provides enough energy to lift and lower the upper frame 12 relative to the lower frame 14 while supporting a patient weighing about 227 kilograms (about 500 pounds) about 20 times before needing a recharge. The number of cycles can be increased by utilizing the manual override, and gravity, to conserve power when lowering the cot from an elevated position (FIG. 1) to a lowered position (FIG. 2). In other embodiments, other voltages and amperes may be used.

As shown by FIGS. 2-3, the upper frame 12 further includes a pair of sidearm supports 32, 32' which are each rotatably mounted to respective side frame members 20, 20'. It is to be appreciated that the pair of sidearm supports 32, 32' rotate about an axis, which is the central axis of each side frame members 20, 20'. Each sidearm support 32, 32' can rotate about 180 degrees from a vertically up position to a nearly vertically down position, or to an outwardly extended position, as is illustrated in FIG. 3.

In another embodiment, the upper frame 12 is a support platform for releasably receiving a multipurpose roll-in cot shown generally as 34 in FIG. 2. The upper frame 12 in this embodiment would be provided without the back and leg rests 26 and 28 (FIG. 3) and would be provided with mounting engagements 36 to support multipurpose roll-in cots such as, for example, the types disclosed by U.S. Pat. No. 4,037,871, and PCT Application No. US01/45144 (WO0239944), references commonly assigned to Ferno Washington, Inc., the disclosures of which are herein fully incorporated by reference.

As best illustrated by FIG. 3, the lower frame 14 is generally rectangular, and has a set of swivel wheels 38 at each corner thereof. The wheels 38 may be conventional caster wheels with foot-operated locking mechanisms. The lower frame 14 comprises a pair of longitudinally extending side frame members 40, 40' separated by three transverse frame members 42, 42', and 42" provided at the loading end, an approximate midsection of the lower frame 14, and the trailing end, respectively.

The support mechanism 16 is an x-frame that includes a first pair of parallel legs 44, 44' and a second pair of parallel legs 46, 46'. Respective ones of the pairs of legs 44, 46 and 44', 46' are pivotably connected at an intermediate location by a pivot brace or connection 48. The upper frame 12 is connected to each of the first pair of legs 44, 44' by a pivot 50 (the pivots on both sides of the frame 12 are the same), which is best shown in FIG. 1. The lower ends of the first pair of legs 44, 44' are pivotably connected to the lower frame 14 by a first slide member 52.

With reference to FIG. 3, the first slide member shown generally as symbol 52 comprises linear bearings 54 slidably supported by longitudinally extending bearing supports or guide 56 and mounted to a bracket 58. If desired, linear bearings 54 and bracket 58 may be a unitary component. As illustrated, the guide 56 is mounted between the transverse frame members 42' and 42" of the lower frame 14. The lower ends of the first pair of legs 44, 44' are also pivotably mounted to bracket 58. The lower ends of the second pair of legs 46, 46' are pivotably connected to the leading transverse frame member 42 of the lower support frame 14 also by pivots 60. The upper ends of the second pair of legs 46, 46' are pivotably connected to upper frame 12 by a second slide member shown generally as 62. The second slide member 62 comprises linear bearings 64 slidably supported by longitudinally extending bearing supports or guide 66, and a bracket 68 upon which the upper ends of the second pair of legs 46, 46' are pivotably mounted. The guide 66 is mounted to the upper frame 12 via a laterally extending brace 70.

Figure 4:
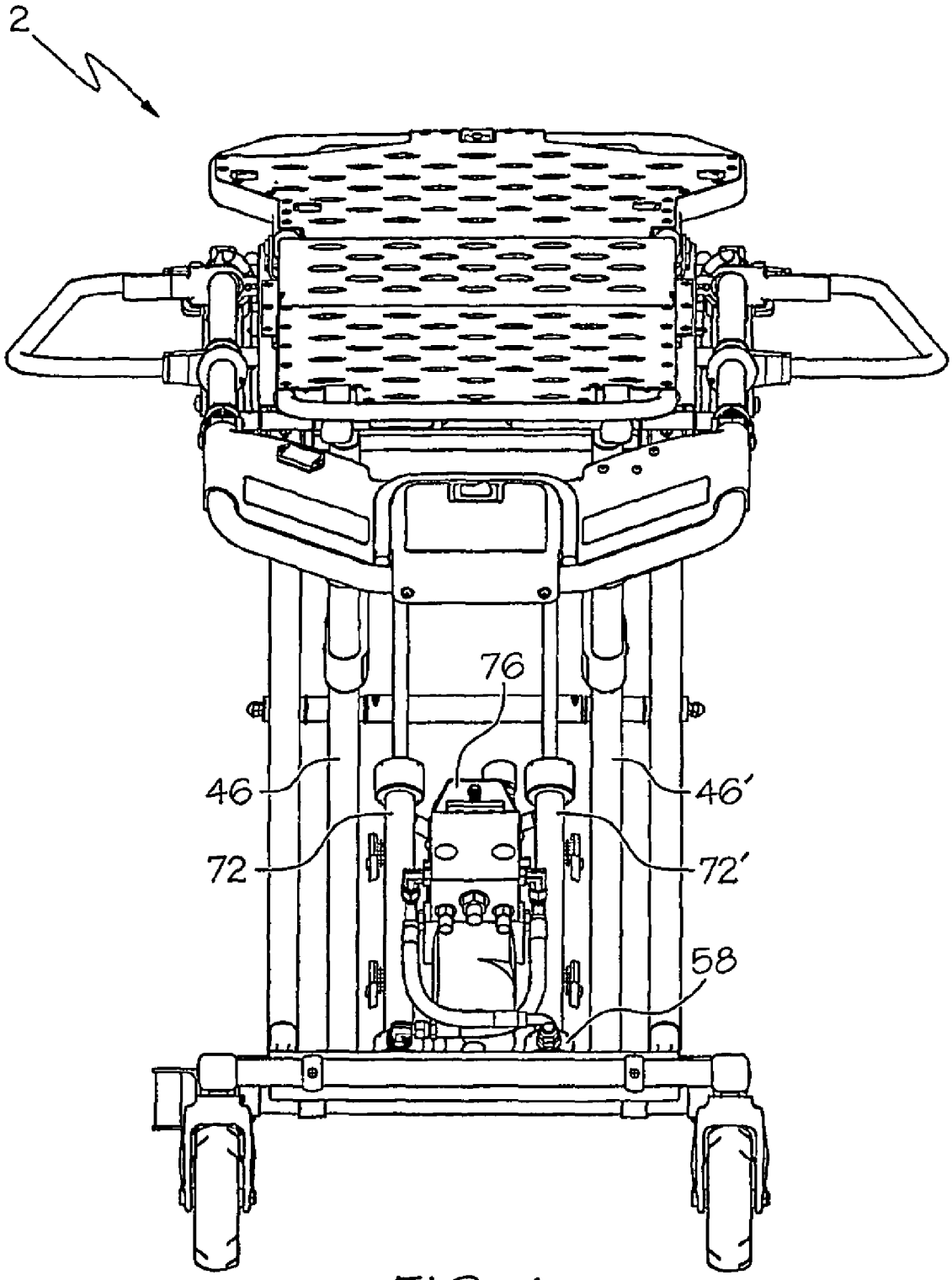
FIG. 4 is an illustrated trailing (operator) end view of a cot according to the invention with parts removed for ease of illustration.

The hydraulic lift system 10 is also pivotably mounted between the second pair of legs 46, 46' and the first slide member 52. As best illustrated by FIGS. 1 and 4, the lift system 10 utilizes a pair of hydraulic cylinders 72, 72'. The lower ends of the cylinders 72 are pivoted off bracket 58 and move along with the first slide member 52. The upper ends of the cylinders 72, 72' are pivoted off a bar attachment 74 mounted between the second pair of legs 46, 46' above the pivot braces or connections 48. The bar attachment 74 mounted above the connections 48 provides a mechanical advantage at the beginning of the lift sequence, wherein slightly less than about 1.8 kilograms (about 4 pounds) of mechanical lift is needed per about 0.45 kilograms (about 1 pound) of patient.

Accordingly, in one exemplary embodiment, based upon utilizing a pair of 2.54 cm (1-inch) diameter hydraulic cylinders with about 25.4 cm (about 10 inches) of stroke and a working pressure of about 13.8 MPa (about 2000 psi), the cot 2 is able to lift a patient weighing about 317.5 kilograms (about 700 pounds). As also best illustrated by FIG. 4, an electro-hydraulic system 76 of the hydraulic lift system 10 is provided to the cot 2 between the pair of hydraulic cylinders 72, 72'. As illustrated in FIG. 5, a protective cover 210 is provided enclosing the electro-hydraulic system 76. The electro-hydraulic system 76 is discussed in greater detail hereafter in reference to FIG. 6.

Figure 6:
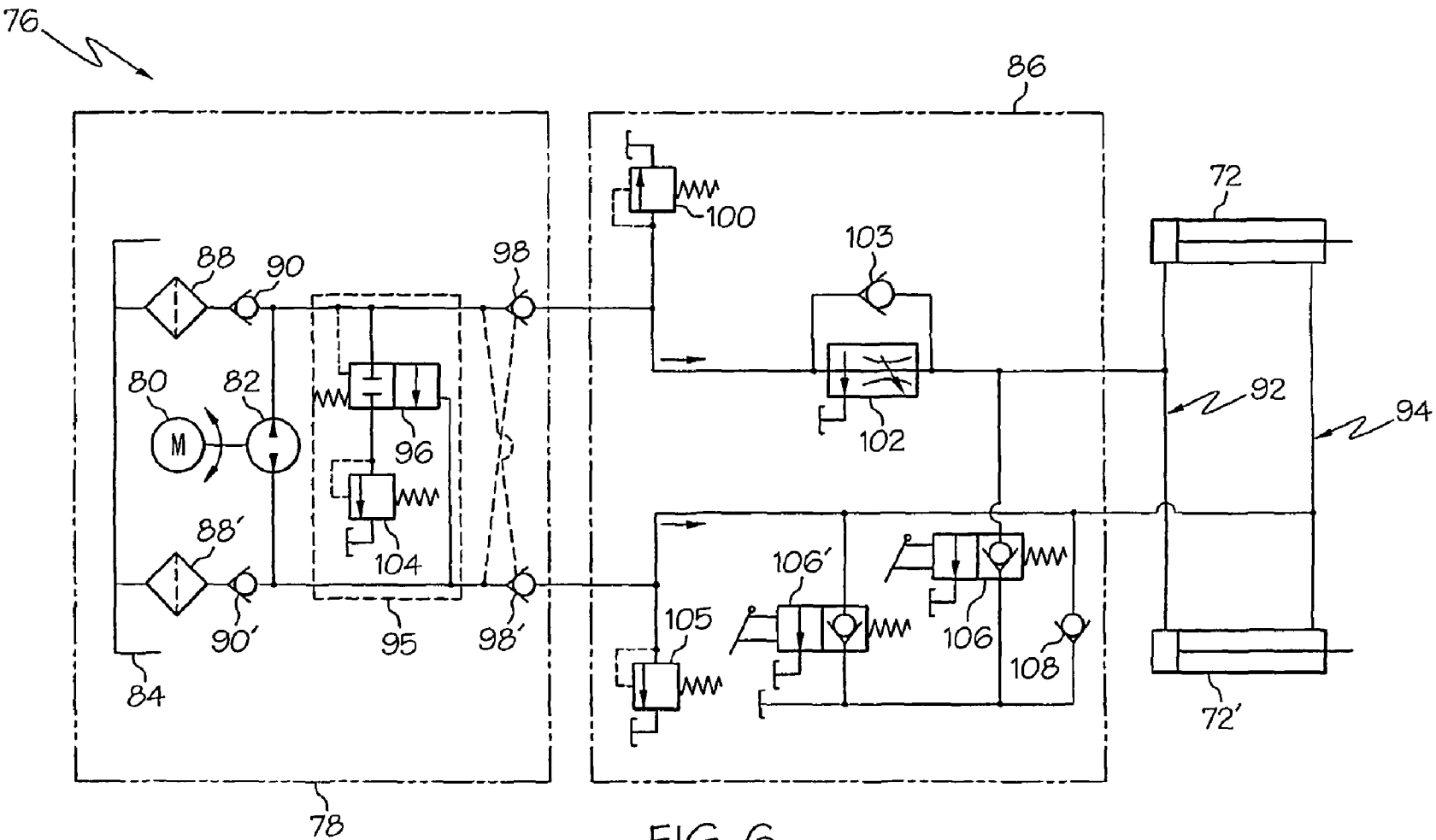
FIG. 6 shows a connection diagram of the hydraulic system according to an embodiment of the present invention.

As can be seen in the FIG. 6, the electro-hydraulic system 76, which serves to hydraulically actuate the vertically adjustable ambulance cot 2, comprises a power unit 78 having an electric motor 80, powered by battery 30 (FIG. 1), driving a pump 82 for supplying the hydraulic fluid from a reservoir 84, and a hydraulic control circuit 86. The power unit 78 is operable in two directions to supply hydraulic fluid from the reservoir 84 (through a respective filter 88 or 88' and respective pair of check valves 90, 98 or 90', 98') to either a first branch 92 or a second branch 94 of the control circuit 86. In the illustrated embodiment, check valves 98, 98' are pilot controlled check valves. Also as illustrated, the pump 82 is in fluid connection between the pairs of check valves 90, 90' and 98, 98' along with a back pressure circuit 95 provided upstream thereof. The backpressure circuit 95 ensures a more smooth and even movement of the hydraulic cylinders without a sharp jerking motion, and includes a spring-controlled unloading valve 96 and a low pressure relief valve 104. The low pressure relief valve 104 is set to relieve back pressures in excess of about 1,034 kiloPascals (about 150 psi).

In the first branch 92 of the control circuit 86, which extends from the power unit 78 to the extension side of the cylinders 72, 72', a high pressure relief valve 100 is positioned, which is set to relieve line pressures in excess of 13.8 MPa (2000 psi). Downstream from the high pressure relief valve 100 is positioned an adjustable compensating feed valve 102. The feed valve 102 provides a wide range of advance and retract feeds, thereby ensuring that the hydraulic fluid is provided to the cylinders 72, 72' in at a controlled and safe rate. However, a bypass check valve 103 is provided around feed valve 102 to ensure that suitable fluid flow is provided to the extension side of the hydraulic cylinders 72, 72', thereby ensuring a smooth extension of cylinders 72, 72' when lifting under power a patient situated on the cot 10.

Additionally, the bypass check valve 103 ensures a vacuum does not form on the extension side of the hydraulic cylinders 72, 72' when manually raising the cot 2 which is explained more fully in a later section. The hydraulic cylinders 72, 72' are under power when the motor 80 is operated to supply fluid under pressure to the first branch 92 in order to extend the cylinders 72, 72', thereby raising the upper frame 12 of the cot 2 relative to the lower frame 14. In one embodiment, the rate of the hydraulic fluid supply to the first branch 92 from the power unit 78 is about 3 liters per minute (about 0.80 GPM).

In the second branch 94, which is parallel to said first branch 92 and which extends between the retraction side of the cylinders 72, 72' and the power unit 78, a high pressure relief valve 105 is positioned, which is set to relieve line pressures in excess of 13.8 MPa (2000 psi). Downstream from the high pressure relief valve 105 is positioned pilot controlled check valve 98'. The motor 80 is operated to supply fluid under pressure to the second branch 94 in order to retract the cylinders 72, 72', thereby lowering the upper frame 12 relative to the lower frame 14. In one embodiment, the rate of the hydraulic fluid supply to the second branch 94 from the power unit 78 is about 2.3 liters per minute (about 0.6 GPM).

Between the first branch 92 and the second branch 94, are located a pair of hand operated spring-return valves 106, 106', used to manually lower or raise the cot 2. The outlets of the hand-operated spring-return valves 106, 106' dump to the reservoir 84. A check valve 108, which flows only in the feed direction of the second branch 94, ensures a vacuum does not form on the bottom side of the hydraulic cylinders 72, 72' when manually lowering the cot 2 via operating the hand-operated spring-return valves 106, 106'.

Talking as an initial position of the cot 2 at the lowered position thereof, the pump 82 of the power unit 78 pumps the fluid into the first branch 92, through the associated pilot control check valve 98, to the pressure compensated feed valve 102 and through the bypass check value 103. It is to be appreciated that supplying hydraulic fluid to the first branch 92 also opens the check valve 98' in the second branch 94 to permit the hydraulic fluid to flow from the bottom of the cylinders 72, 72' back to the inlet of the pump 82.

When the pressure required for lifting the cylinders 72, 72' has been reached, the cylinders 72, 72' will be accelerated continuously and slowly until it has reached its maximum speed depending on the properties of the fluid flow and pressure drop. In the course of this process, the pressure in the first branch 92 up to the inlet of the feed valve 102 and through bypass check valve 103 will exceeds the pressure in the cylinders 72, 72' as the amount of fluid delivered by the pump 82 is larger than the maximum amount of fluid flowing through the feed valve 102 and bypass check value 103. Accordingly, the excessive amount of fluid in the first branch 92 is then discharged into the reservoir 84 by being dumped via feed valve 102. It follows that a constant lifting movement is carried out until the power unit 78 is switched off.

A short time after switching off the power unit 78, such as when reaching the desired level for the upper frame 12 of the cot 2, the pilot operated check valve 98 in the first branch 92 remains closed as long as the pressure at its inlet does not exceed the pressure in the cylinder or is opened by operating the power unit in the opposite direction. Hence, the cylinders 72, 72', are prevented from retracting. Exactly the opposite takes place in the second branch 94 when lowering the upper frame 12 by operating power unit in the reverse direction.

Figure 7:
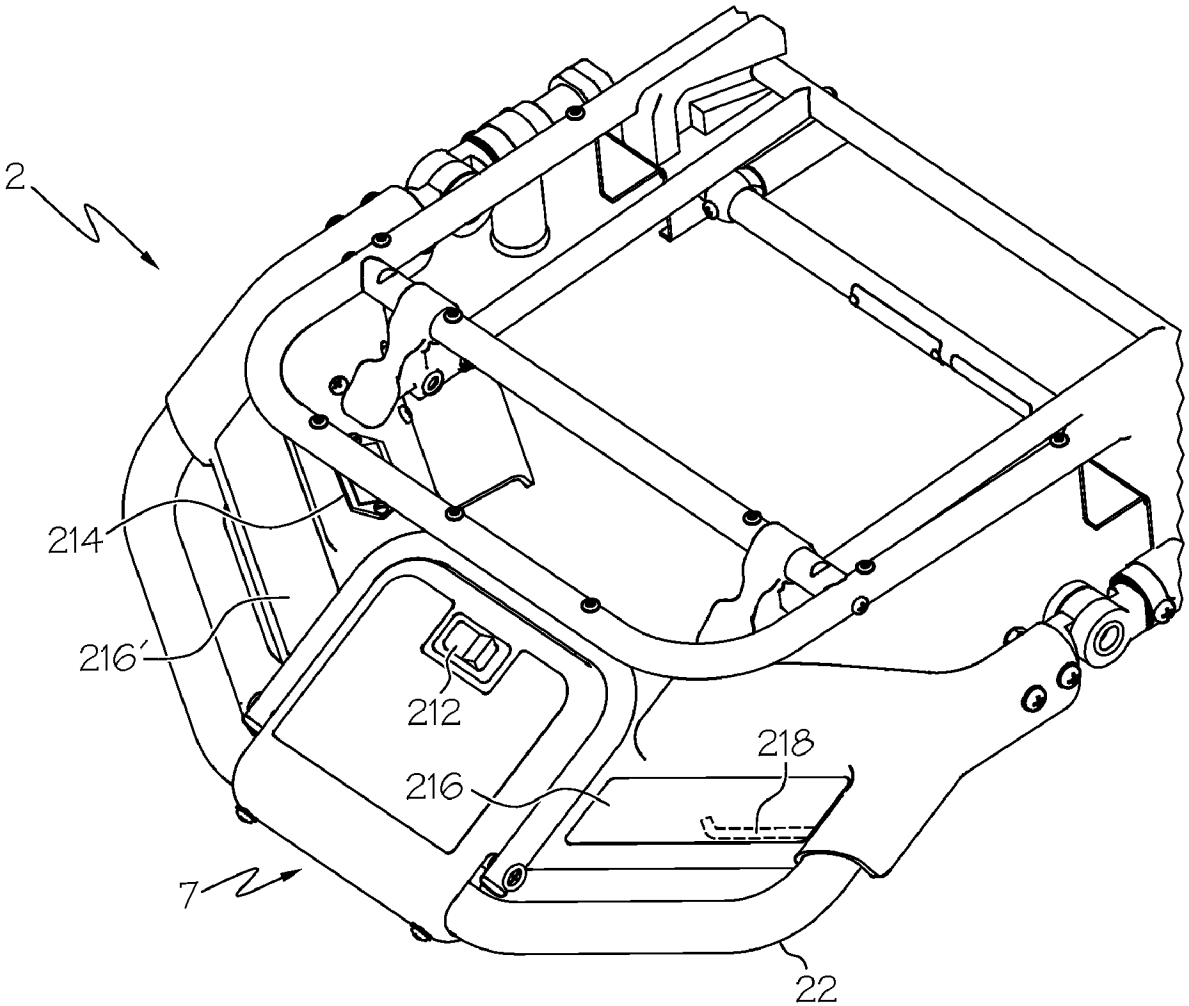
FIG. 7 is an illustrated close-up section view of a trailing (operator) end of a cot according to the present invention.

Turning to FIG. 7, an illustrated close-up section view of a trailing (operator) end 7 of the cot 2 according to the present invention is shown. As illustrated, the trailing (operator) end 7 of the cot provides the end frame member 22, which has a bent U-shape, and like the leading end frame member 18 (FIG. 3), is also a drop frame with a plurality of locking positions. It is to be appreciated that the trailing end frame member 22 can be raised or lowered with two hands, and along with its bent U-shape, thereby provides additional lifting points for better ergonomics and fewer injuries, and reduces overall length of the cot for easier maneuverability in confined spaces.

Provided to the trailing end frame member 22 is an on/off button 212 used to energize the motor 80 in the power unit 78 (FIG. 6) with battery 30 (FIG. 1). A battery charge indicator 214 is also provided, which indicates battery state of charge. Relatively large thumb control switches 216, 216' used to control the up and down operation of the cot 2, are also provided to the trailing end frame member 22. It is to be appreciated that the U-shape of the trailing end frame member 22 and the relatively large thumb control switches 216, 216', provide for a wide range of hand sizes and gripping points along the frame member 22, thereby making it easier for two operators to load the cot while both sets of hands are holding the cot from the trailing (operator) end 7. An actuator 218 for the manual operation mode of the cot 2 is also provided at the trailing (operator) end 7.

While the invention has been described by reference to certain preferred embodiments, it should be understood that numerous changes could be made within the spirit and scope of the inventive concepts described. For example, all relief valves may be variably adjusted, and that although in one embodiment the above mentioned pressures are suitable, other system pressures may be used without departing from the scope and spirit of the invention. Accordingly, it is intended that the invention not be limited to the disclosed embodiments, but that it have the full scope permitted by the language of the following claims.

The invention claimed is:

1. A hydraulically powered lift ambulance cot comprising:

a wheeled base having a first slide member slidably supported by a longitudinally extending lower guide;

a support frame having a second slide member slidably supported by a longitudinally extending upper guide, said support frame is disposed above said wheeled base;

a support mechanism which supports said support frame relative to said wheeled base, said support mechanism is pivotably connected to said support frame, said wheeled base, said first slide member, and said second slide member; wherein said support mechanism is an x-frame that includes a first pair of parallel legs and a second pair of parallel legs, respective ones of the pairs of legs are pivotably connected at an intermediate location by a pivot brace;

a hydraulic lift system pivotably mounted at a first end to said first slide member, and at a second end to said support mechanism, said hydraulic system comprising:

at least one cylinder for vertically adjusting the ambulance cot;

a power unit having a bi-directional pump;

a control circuit having a first branch in fluid connection with both the pump and an extension side of the at least one cylinder at a first location, a second branch in fluid connection with both the pump and a retraction side of the at least one cylinder at a second location, the first and second locations being on opposite sides of a piston dividing the at least one cylinder into the extension side and the retraction side, and a pair of hand-operated spring-return valves in fluid connection between the first and second branches; and a battery provided to said cot to supply electricity to the hydraulic lift system in order to assist relative movement between said support frame and said wheeled base.

2. The hydraulically powered lift ambulance cot according to claim 1, wherein said support frame forms a bed having an adjustable head end, and said battery releasably mounted below said head end.

3. The hydraulically powered lift ambulance cot according to claim 1 wherein the first slide member comprises linear bearings slidably supported by the lower guide and mounted to a bracket upon which the lower ends of the first pair of legs of said support mechanism are pivotably mounted.

4. The hydraulically powered lift ambulance cot according to claim 1 wherein the second slide member comprises linear bearings slidably supported by the upper guide and a bracket upon which the first ends of the second pair of legs of said support mechanism are pivotably mounted.

5. The hydraulically powered lift ambulance cot according to claim 1 wherein the first slide member comprises linear bearings slidably supported by the lower guide and mounted to a bracket upon which the lower ends of the first pair of legs of said support mechanism are pivotably mounted, and wherein the second slide member comprises linear bearings slidably supported by the upper guide and a bracket upon which the first ends of the second pair of legs of said support mechanism are pivotably mounted.

6. The hydraulically powered lift ambulance cot according to claim 1, wherein said hydraulic lift system is pivotably mounted at said second end to said first pair of parallel legs above each pivot brace.

7. The hydraulically powered lift ambulance cot according to claim 1, wherein the first pair of parallel legs have a first end pivotably connected to said first slide member and a second end pivotably connected to said support frame, and the second pair of parallel legs have a first end pivotably connected to said base and a second end pivotably connected to said second slide member.

8. The hydraulically powered lift ambulance cot according to claim 1, wherein the hydraulic lift system comprises two hydraulic cylinders, wherein lower ends of the cylinders are pivoted off the first slide member and move said first slide member to adjust the vertical position between the support frame and wheeled base.

9. The hydraulically powered lift ambulance cot according to claim 1, wherein the hydraulic lift system comprises two hydraulic cylinders, wherein lower ends of the cylinders are pivoted off a bracket of the first slide member and move said first slide member to adjust the vertical position between the support frame and wheeled base, and upper ends of the cylinders are pivoted off a bar attachment mounted offset from and above said pivot braces.

10. The hydraulically powered lift ambulance cot according to claim 1, wherein said first branch comprises a pressure compensated feed valve, a bypass check valve around said pressure compensated feed valve, and a pressure relief valve.

11. The hydraulically powered lift ambulance cot according to claim 1, wherein said second branch comprises a pressure relief valve.

12. The hydraulically powered lift ambulance cot according to claim 1, wherein the power unit provides about 3 liters per minute (about 0.8 GPM) to the first branch, and about 2.3 liters per minute (about 0.6 GPM) to the second branch.

13. The hydraulically powered lift ambulance cot according to claim 1, wherein the power unit further comprises power unit check valves.

14. The hydraulically powered lift ambulance cot according to claim 1, wherein the pair of pressure relief valve are set to relieve at about 11,032 kiloPascals (about 1600 psi) and about 13,790 kiloPascals (about 2000 psi), respectively.

15. The hydraulically powered lift ambulance cot according to claim 1, further comprising a fastening device provided to a first side frame member of said cot and electrical contact pads provided to a second side frame member of said cot, said electrical contact pads are configured to make an electrical connection between an external source and said battery when said cot is releasably secured in an emergency vehicle by said fastening device.

16. The hydraulically powered lift ambulance cot according to claim 13, wherein the power unit check valves are pilot operated.

17. The hydraulically powered lift ambulance cot according to claim 1, wherein each output side of the pair of hand-operated spring-return valves is in fluid connection with a check valve in fluid connection with the second branch.

* * * * *